United States Patent [19]

Nakagawa

[11] Patent Number: 4,592,325

[45] Date of Patent: Jun. 3, 1986

[54] AIR/FUEL RATIO CONTROL SYSTEM

[75] Inventor: Toyoaki Nakagawa, Yokohama, Japan

[73] Assignee: Nissan Motor Co., Ltd., Yokohama, Japan

[21] Appl. No.: 726,586

[22] Filed: Apr. 23, 1985

[30] Foreign Application Priority Data

Apr. 24, 1984 [JP] Japan ..... 59-82494

[51] Int. Cl.[4] ..... F02D 43/00

[52] U.S. Cl. ..... 123/489; 123/440; 123/486

[58] Field of Search ..... 123/489, 440, 480, 486, 123/487, 436

[56] References Cited

U.S. PATENT DOCUMENTS 4,130,095 12/1978 Bawlor et al. ..... 123/440
4,232,643 11/1980 Leshnor ..... 123/436
4,345,562 8/1982 Drews et al. ..... 123/489
4,491,921 1/1985 Sugiyama et al. ..... 123/489
4,508,075 4/1985 Takao et al. ..... 123/489
4,517,948 5/1985 Kaji et al. ..... 123/489
4,542,729 9/1985 Yamato et al. ..... 123/489

*Primary Examiner*—Raymond A. Nelli

*Attorney, Agent, or Firm*—Schwartz, Jeffery, Schwaab, Mack, Blumenthal & Evans

[57] ABSTRACT

An air/fuel ratio control system uses an oxygen sensor with which the air/fuel ratio of rich fuel mixture is measured. In this system, a feedforward control of the air/fuel ratio is executed even under operating condition when the engine operates on the rich fuel mixture, and a feedforward control of the air/fuel ratio is executed to enrich the fuel mixture at acceleration in accordance with a control data table which is subject to change after learning during the engine operation.

4 Claims, 14 Drawing Figures

AIR/FUEL RATIO CONTROL SYSTEM

BACKGROUND OF THE INVENTION

The present invention relates to a system for controlling an air/fuel ratio of a fuel mixture supplied to an internal combustion engine.

In order for precise control of the air/fuel ratio, the feedback control systems employing an oxygen sensor are widely used in the automotive industry. In the feedback control systems, the amount of fuel required by the engine is precisely calibrated in accordance with input data involving the sensor output of the oxygen sensor indicative of the oxygen concentration in exhaust gases.

The typical feedback control systems for precise control of the air/fuel ratio are briefly discussed hereinafter.

(I) Feedback control to the stoichiometry:

In this feedback control, a correction coefficient is determined in response to the output signal of an oxygen sensor installed to probe the exhaust gases. With this correction coefficient, the basic amount of fuel to be supplied to the engine is corrected, so the actual air/fuel ratio is closely adjusted to the stoichiometry. The oxygen sensor employed by this known system cannot detect the air/fuel ratio of the rich fuel mixture. This system is described in a technical paper entitled "ECCS L-series Engine" published in June 1981 by Nissan Motor Company Limited.

(II) Feedback to the air/fuel ratio of the lean fuel mixture:

Laid-open Japanese Patent Application No. 56-89051 discloses a feedback control system which employs an oxygen sensor for precise control of the air/fuel ratio of the lean fuel mixture. Although it can detect the air/fuel ratio of the lean fuel mixture over a wide range, this oxygen sensor can not detect the air/fuel ratio of the rich fuel mixture over a wide range.

(III) Feedback control with a learning mode:

Laid-open Japanese Patent Application No. 58-124032 discloses a control system which has the learning mode to determine an appropriate input data for feedback control for the subsequent use for a feedforward control under operating condition where the output of an oxygen sensor is not relied upon, for example, for engine cranking.

In the above discussed known control systems, the feedback control is clamped so as to enrich the fuel mixture to operate the engine on the rich fuel mixture for engine warming-up, heavy (full) load, and transients. Because the conventional oxygen sensor cannot detect the air/fuel ratio of the rich fuel mixture over a wide range, the control precision of the air/fuel ratio has been decreased under operating conditions of the engine where the rich fuel mixture is required, resulting in deterioration in driveability if the actual mixture is leaner than desired or increased exhaust emissions if the actual mixture is richer than desired.

SUMMARY OF THE INVENTION

An object of the present invention is to improve an air/fuel ratio control system such that the control precision of the air/fuel ratio under operating conditions where the engine operates on the rich fuel mixture is increased.

Another object of the present invention is to provide a system for controlling the air/fuel ratio wherein the control precision of the air/fuel ratio for transient operating condition of the engine is increased.

Still another object of the present invention is to provide a system for controlling the air/fuel ratio wherein a learning mode is employed to increase the precision control of the air/fuel ratio in enriching the fuel mixture for acceleration.

According to one feature of the present invention, the feedforward control of the air/fuel ratio is effected for acceleration in accordance with data which is subject to change due to learning that is carried out after a predetermined condition has been satisfied during operation of the engine.

According to another feature of the present invention, the feedback control of the air/fuel ratio is effected in accordance with data which is subject to change due to learning that is carried out after a predetermined condition has been satisfied during operation of the engine.

DESCRIPTION OF THE EMBODIMENT

Figure 1:
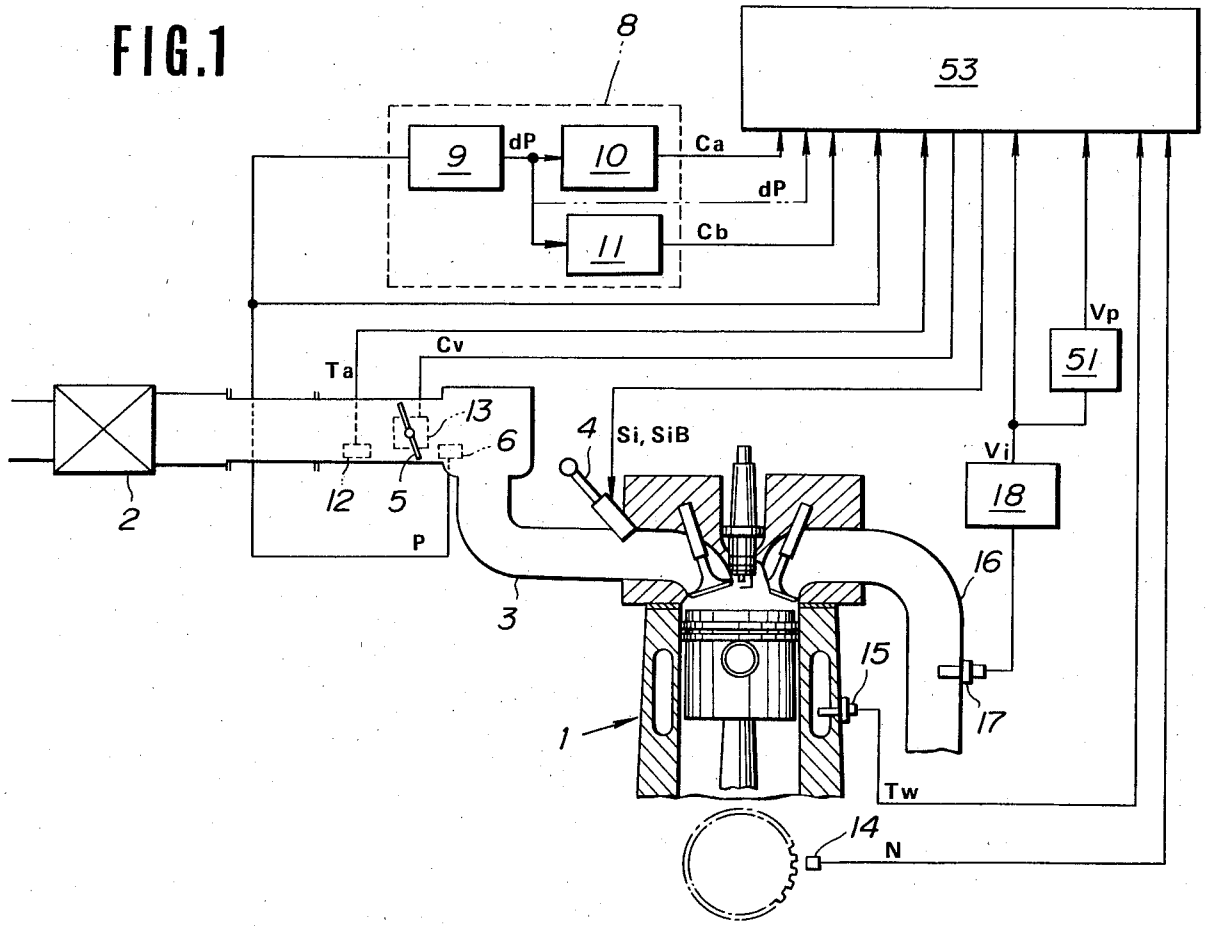
FIG. 1 is a schematic view of a system according to the present invention.

Referring to FIG. 1, an engine 1 has an intake system including an air cleaner 2 and an intake manifold 3 with injector means 4. Intake air is admitted to each of cylinders of the engine after passing through the air cleaner 2 and intake manifold 3. Fuel is injected to the flow of the intake air by means of the injector means 4. The amount of fuel to be injected is determined by fuel injection signals Si and Sia which will be further described later. The amount of intake air is regulated by a throttle valve 5. Downstream of the throttle valve 5 is created manifold vacuum which is measured by a vacuum sensor 6. The output signal P of the vacuum sensor 6 is fed to a transient detecting unit 8 which comprises a differentiating circuit 9, an acceleration deciding circuit 10, and a deceleration deciding circuit 11. The circuit 9 differentiates the output signal P indicative of the manifold vacuum with respect to time t (dP/dt) and generates a signal indicative of a change in manifold pressure dP. This signal dP is fed to the acceleration deciding circuit 10 and deceleration deciding circuit 11, too. The acceleration deciding circuit 10 compares the signal dP with a first predetermined reference and generates an acceleration signal Ca when the signal dP is greater than the first predetermined reference. The deceleration deciding circuit 11 compares the signal dP with a second predetermined reference which is lower than the first reference and generates a deceleration signal Cb when the signal dP is less than the second predetermined reference.

Intake air temperature sensor 12 measures the temperature of the intake air and generates an intake air temperature indicative signal Ta. Throttle valve opening degrees sensor 13 detects opening degree of the throttle valve 5 and generates a throttle opening degree indicative signal Cv. Crank angle sensor 10 measures the engine speed and generates an engine speed indicative signal N. Coolant temperature sensor 15 measures the engine coolant temperature and generates a coolant temperature indicative signal Tw. Oxygen sensor 17 is installed to probe exhaust gases in an exhaust pipe 16 and connected with an air/fuel ratio detecting circuit 18.

Figure 2:
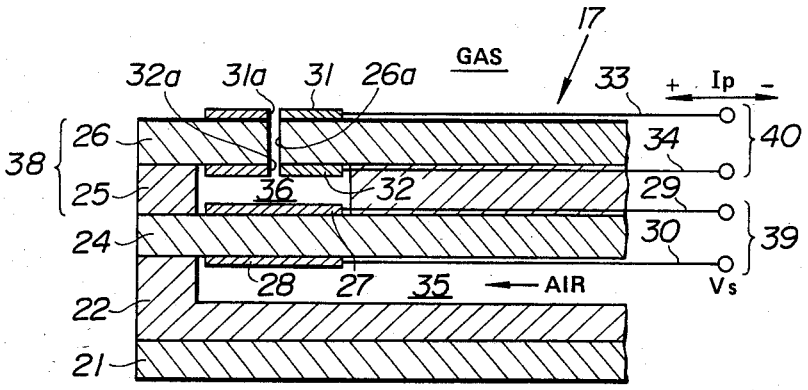
FIG. 2 is a sectional view of an oxygen sensor used in the system.
Figure 3:
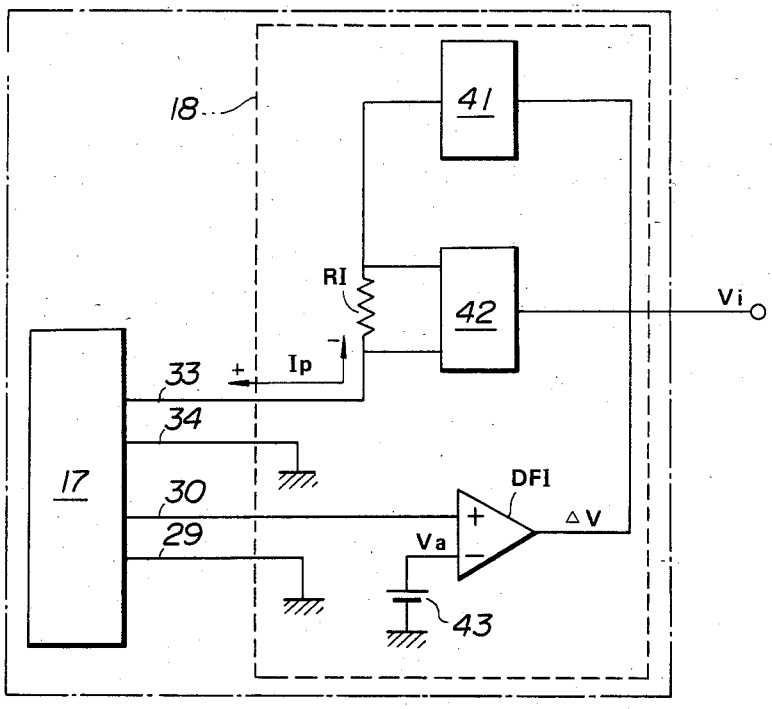
FIG. 3 is a circuit diagram of an air/fuel ratio detecting circuit with the oxygen sensor.

Referring to FIGS. 2 and 3, the oxygen sensor 17 and its associated air/fuel ratio detecting circuit 18 are further described. With this oxygen sensor 17, the air/fuel ratio of the rich fuel mixture over a wide range can be detected in addition to the detection of the stoichiometry and the air/fuel ratio of the lean fuel mixture over a wide range.

Referring to FIG. 2, the oxygen sensor 17 comprises a flat base plate 21 of an insulating material of alumina. Laid on an upper side of the base plate 21, as viewed in FIG. 2, is a reference gas admitting plate 22 of an insulating material having a channel-like reference gas receiving gutter 23 closed at one end. This gutter 23 is formed in an upper side, as viewed in FIG. 2, of the reference gas receiving plate 22. Laid on the upper side of the reference gas receiving plate 22 is a first solid electrolyte plate 24. Laid on an upper side of the first electrolyte plate 24 is a spacer plate 25 of an insulating material formed with a window-like opening 25a. Laid on an upper side, as viewed in FIG. 2, of the spacer plate 25 is a second solid electrolyte plate 26. As shown in FIG. 2, the first and second solid electrolyte plates 24 and 26 are arranged in parallel and they are formed of an oxygen ion-conductive solid electrolyte. The second solid electrolyte plate 26 is formed with a small hole 26*a* opening to the window-like opening 25*a*. The first solid electrolyte plate 24 has a measurement electrode 27 and a reference electrode 28 which are printed on the upper and lower sides of the second solid electrolyte plate 24. These electrodes 27 and 28 which are formed of a material including gold as a main constituent are connected with lead lines 29 and 30, respectively. The electrode 27 is arranged within the window-like opening 25*a* in opposite relationship to the other electrode 28 with the first solid electrolyte 24 interposed therebetween. The second solid electrolyte plate 26 has a pump anode 31 and a pump cathode 32 printed on the upper and lower sides thereof, respectively. The pump cathode 31 and anode 32 are in opposite relationship to each other and formed with small holes 31*a* and 32*a*, respectively, which are aligned with the hole 26*a*. The pump anode 31 and cathode 32 are connected with lead lines 33 and 34, respectively.

The reference gas receiving plate 22 and the first solid electrolyte plate 24 cooperate to define the exhaust gas receiving space 35 for receiving a reference gas, atmospheric air in this embodiment, therein (see arrow indicated by AIR). The second solid electrolyte plate 26 and the spacer plate 25 cooperate to define within the window-like opening 25*a* an enclosed space 36 to which the measurement electrode 27 is exposed. The upper side of the second solid electrolyte plate 26 is exposed to exhaust gases as indicated by the symbol GAS. The enclosed space 36 is allowed to communicate with the exhaust gases via a narrow passage consisting of the small holes 31*a*, 26*a* and 32*a*. The spacer plate 25 and second solid electrolyte plate 26 cooperate with each other to form an oxygen layer defining member 39 which restricts the rate of diffusion of oxygen molecule per unit time between the exhaust gas atmosphere and the enclosed space 36.

The first solid electrolyte plate 24, measurement electrode 27 and reference electrode 26 cooperate with each other to form a sensor section 39, while the second solid electrolyte plate 26, pump anode 31 and pump cathode 32 cooperate with each other to form a pump section 40. With the reference electrode 28 exposed to the atmospheric air and the measurement electrode 28 exposed to the exhaust gases within the space 36, the electromotive force E is developed between the electrodes 27 and 28. This electromotive force E is generated in terms of an output voltage Vs of the sensor section 29. The pump section 40 is supplied with a pump electric current Ip by an electric current supply unit which will be described later, so the pump current Ip flows between the pump electrodes 31 and 32. The flow of this pump current Ip causes migration of oxygen ions within the second solid electrolyte plate 26 in the opposite direction to the flow of the pump current Ip. The intensity of the migration of oxygen ions is proportional to the intensity of the pump current Ip. Thus, the pump section 40 functions to cause oxygen molecules to migrate between the lower side of the second solid electrolyte plate 26 exposed to the space 36 and the upper side thereof exposed to the exhaust gases. Although not illustrated in FIG. 2, an electric heater is embedded into the base plate 21 for assuring that the oxygen sensor reaches a predetermined minimum temperature as soon as possible (20 seconds) after engine startup.

Referring to FIG. 3, the electrodes 27, 28, 31 and 32 are circuited with the air/fuel ratio detecting circuit 18 via the associated lead lines 29, 30, 33 and 34. The air/fuel ratio detecting circuit 18 comprises a pump electric current supply unit 41, a pump electric current detection unit 42, a source of reference electric voltage 43, a differential amplifier DFI, and a resistor RI. The differential amplifier DFI compares the output voltage Vs of the sensor section 39 with a reference voltage Va generated by the source of reference electric voltage 43 and generates an output voltge $\Delta V$ which is indicative of a difference that may be expressed by $\Delta V = K2\ (Vs - Va)$, where; K2 = the constant. This output signal $\Delta V$ is fed to the pump electric current supply unit 41. The reference electric voltage Va is set at a middle value between the upper and lower limits between which the electric voltage Vs rapidly changes versus variation in oxygen concentration in the exhaust gases disposed within the space 36. The rapid change in the output voltage Vs takes place at different air/fuel ratios against different values in the pump electric current Ip. Therefore, the actual air/fuel ratio can be detected by varying the intensity of the pump electric current Ip until the difference output ΔV becomes zero and detecting the intensity of the pump electric current Ip when the ΔV becomes zero. The intensity of the pump electric current Ip is detected by the pump electric current detection unit 42 in terms of a potential drop across the resistor RI. Thus, the electric voltage Vi indicative of this potential drop is generated as a signal indicative of the actual air/fuel ratio.

If the pump electric current Ip suppled to the pump section 40 is varied so as to bring Vs into agreement with Va, the oxygen partial pressure within the space 36 is determined by oxygen pumping action due to the pump electric current Ip. Assuming now that the exhaust gas has a temperature of 1000° K. and, for the purpose of creating within the space 36 the oxygen partial pressure corresponding to the stoichiometric air/fuel ratio, Va is set at 500 mV, the oxygen partial pressure Pb at the measurement electrode 27 can be given by Nernst's equation as follows and $Pb=0.206\times10^{-10}$ atm.

$$E=(RT/4F)\ 1n(Pa/Pb) \quad (1)$$

where:

E=the electromotive force,

Pa=the oxygen partial pressure at the reference electrode 28

Pb=the oxygen partial pressure at the measurement electrode 27,

R=the gas constant,

T=the absolute temperature, and

F=the Faraday constant.

Figure 4:
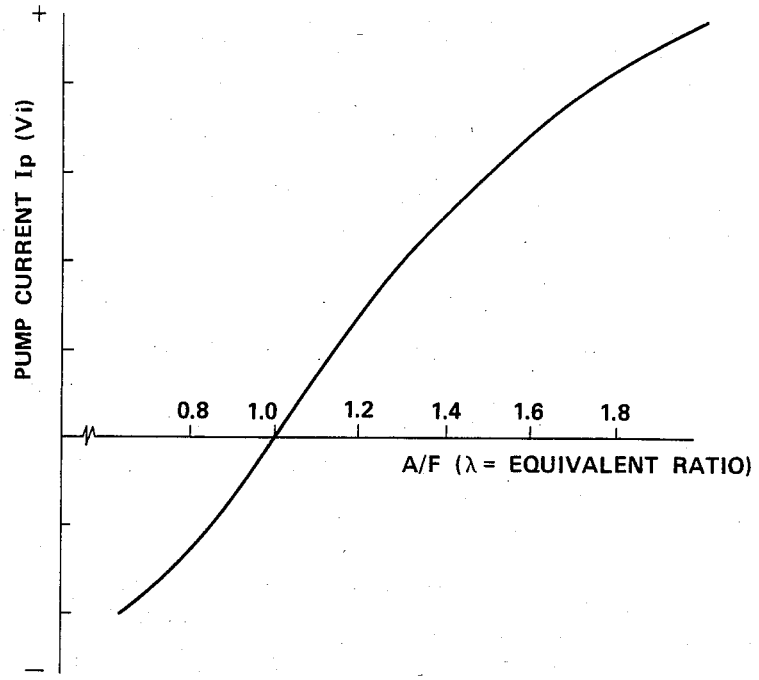
FIG. 4 is a characteristic curve of the output voltage of the air/fuel ratio detecting circuit against variation in air/fuel ratio in terms of the equivalent ratio.

The intensity of the pump electric current Ip at which the oxygen partial pressure Pb comes into agreement with the above mentioned predetermined value $0.206\times10^{-10}$ atm. represents the magnitude of the energy for pumping oxygen ions. Thus, the variation in the intensity of the pump electric current coincides with the variation in the oxygen partial pressure within the exhaust gases. This relationship is illustrated by Vi vs. λ characteristic curve in FIG. 4, where: λ=the equivalent ratio. As will be readily understood from FIG. 4, the air/fuel ratio can now be detected continually over a wide range by measuring the electric voltage Vi. This electric voltage Vi becomes zero at the stoichiometry and gradually varies against the variation in the air/fuel ratio over a wide range on the opposite side of the stoichiometry. The intensity of the pump electric current Ip corresponds to the number of oxygen molecule $O_2$ disposed within the exhaust gas resulting from the combustion of the lean fuel mixture, but it corresponds to the amount of CO or HC contained in the exhaust gas resulting from the combustion of the rich fuel mixture. The direction of flow of the pump electric current Ip switches at the stoichiometry. For further information as to the above mentioned oxygen sensor and the associated air/fuel ratio detection circuit, reference should be made to copending U.S. patent application Ser. No. 702,538 filed on Feb. 19, 1985 in the name of Tshuyoshi Kitahara. This copending U.S. application has been commonly assigned herewith.

Referring back to FIG. 1, the air/fuel ratio detecting circuit 18 feeds its output signal Vi, to a peak detector or a peak holding circuit 51 where it holds and traces the peak value (the peak value on the lean side in this embodiment) Vp of the electric voltage Vi. The various output signals from the vacuum sensor 6, transient detecting unit 8, intake air temperature sensor 12, throttle opening degree sensor 13, crank angle sensor 14, coolant temperature sensor 15, air/fuel ratio detecting circuit 18 and peak detector 51 are fed to a control unit 53.

Figure 5:
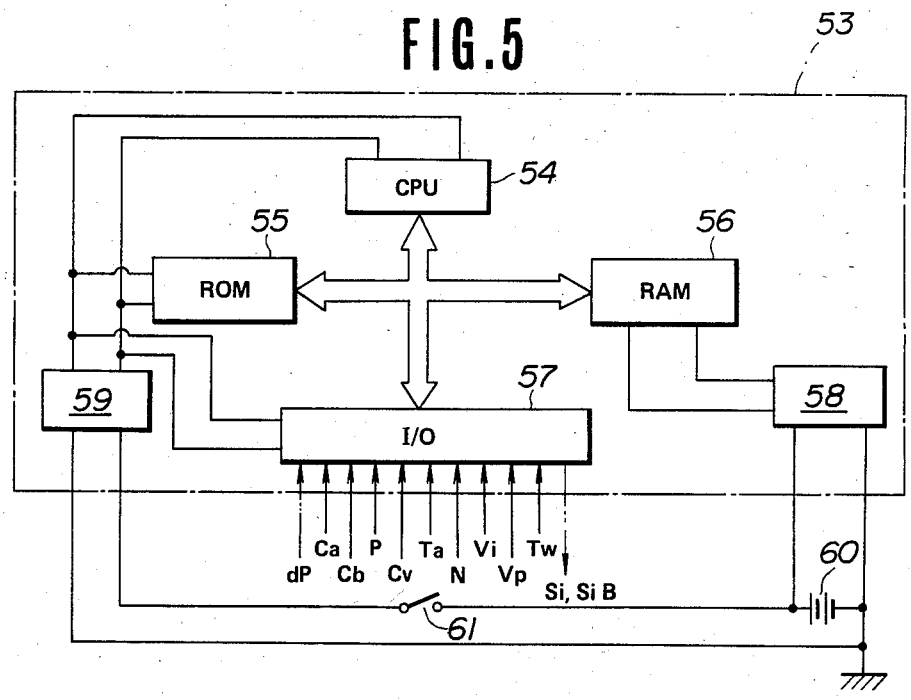
FIG. 5 is block diagram of a control unit.

As best seen in FIG. 5, the control unit 53 comprises a CPU 54, a ROM 55, a RAM 56, an I/O interface 57 and voltage stabilizer circuits 58, 59. The voltage stabilizer circuit 58 is always supplied with a DC current from a battery 60 and it supplies the RAM 56 with stabilized voltage, for example, 5 V. This is the reason why stored data within the RAM 56 is held even after the engine has stopped. On the other hand, the other voltage stabilizer circuit 58 is always supplied with the same DC current via an ignition switch 61, and it suppies the CPU 54, ROM 55 and I/O interface 57 with stabilized voltage when the ignition switch 61 is closed. Thus, the control unit 53 is put into operation when the ignition switch 61 is closed. When, in operation, the CPU 54 fetches necessary external data via the I/O interface 57, exchanges data with the RAM 56 to perform arithmetic operation, and outputs data resulted from arithmetic operation to the I/O interface 57.

Referring to FIGS. 6 to 14, the operation of this embodiment is hereinafter described.

Figure 6:
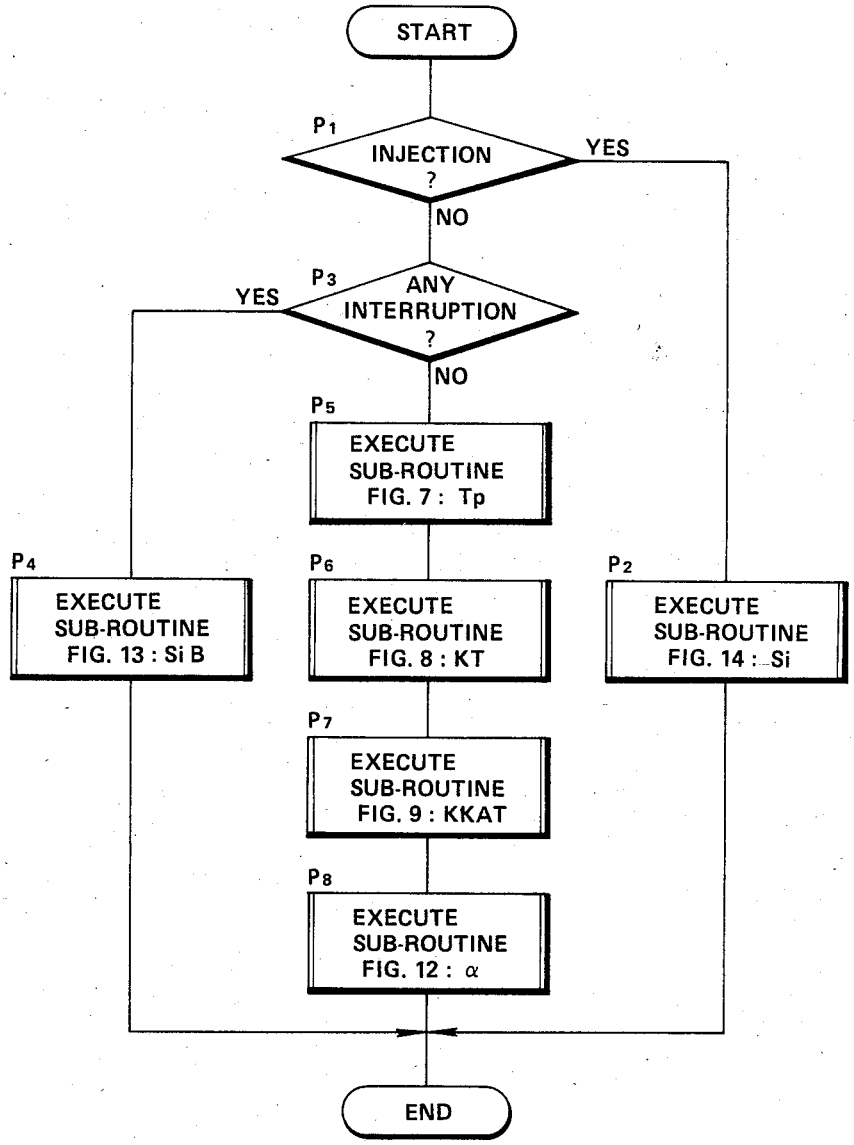
FIG. 6 is a flowchart of a main routine of a control program.
Figure 14:
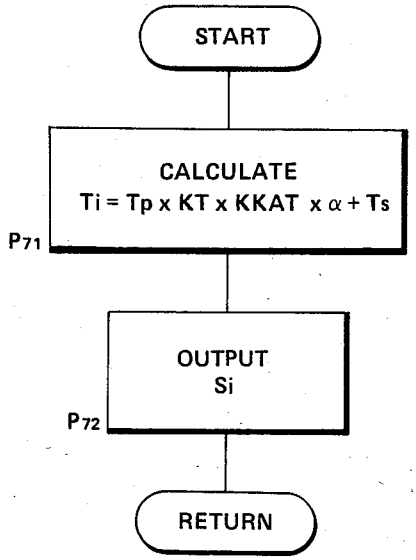
FIG. 14 is a flowchart of a sub-routine of athe control program for determing and outputting amount of fuel for ordinary fuel injection.

FIG. 6 is a flowchart of a main routine of an air/fuel ratio control program stored in the ROM 55. The execution of this main routine is caused at predetermined intervals. First of all, a step P1 is executed to decide whether a fuel injection timing indicative flag is set or not. If the answer to the step P1 is YES, the execution of a sub-routine shown in FIG. 14 is initiated in a step P2 so as to output the fuel injection signal Si after determining a so-called ordinary amount of fuel Ti which can be expressed as:

$$Ti=Tp\times KT\times KKAT\times\alpha+Ts \quad (2),$$

where:

Tp=the basic amount of fuel for injection,

KT=the correction coefficient taking into account various possible causes,

KKAT=the correction coefficient for fuel enrichment for transient,

α=the correction coefficient taking into account error in air/fuel ratio from a desired value, and Ts=the correction coefficient taking into account response delay of fuel injector 4.

Figure 7:
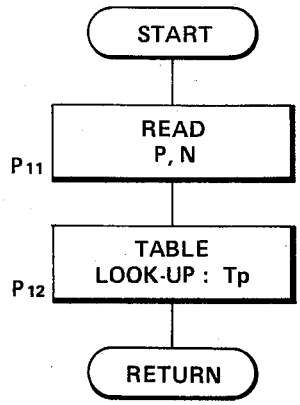
FIG. 7 is a flowchart of a sub-routine of the control program for determining a basic amount of fuel.
Figure 8:
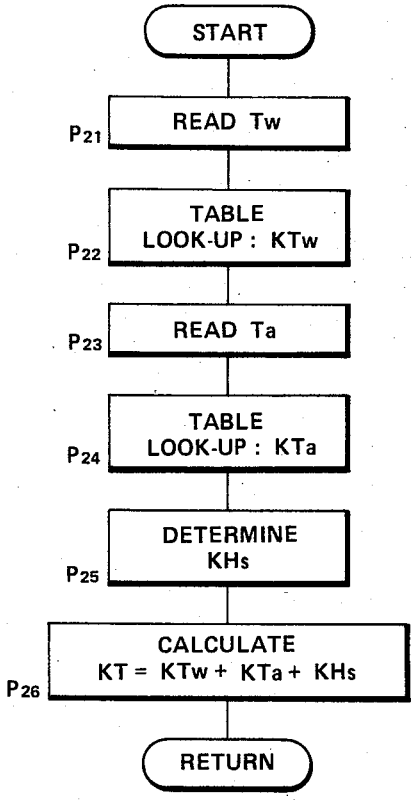
FIG. 8 is a flowchart of a sub-routine of the control program for determining a correction coefficient taking into account various possible causes involving coolant temperature and intake air temperature.
Figure 9:
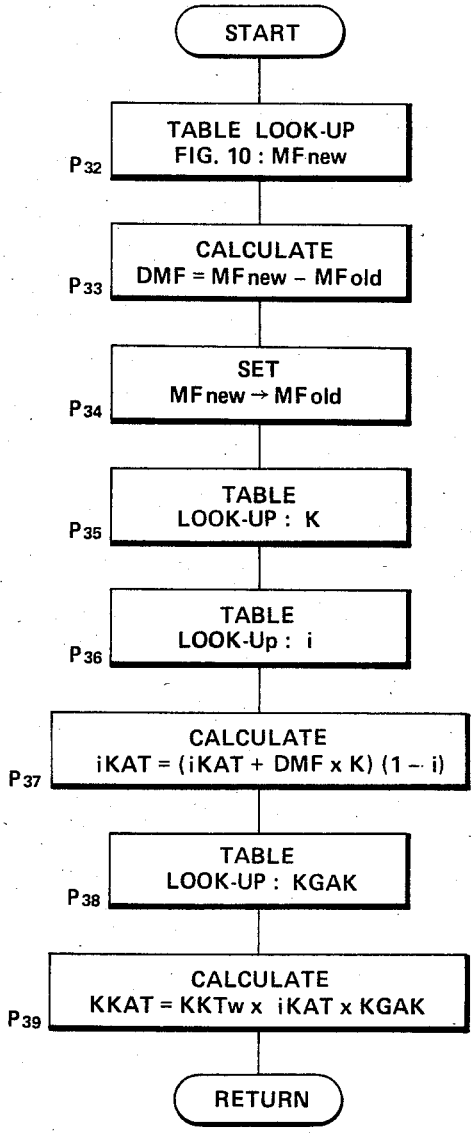
FIG. 9 is a flowchart of a sub-routine of the control program for determining a correction coefficient for fuel enrichment for transient.
Figure 12:
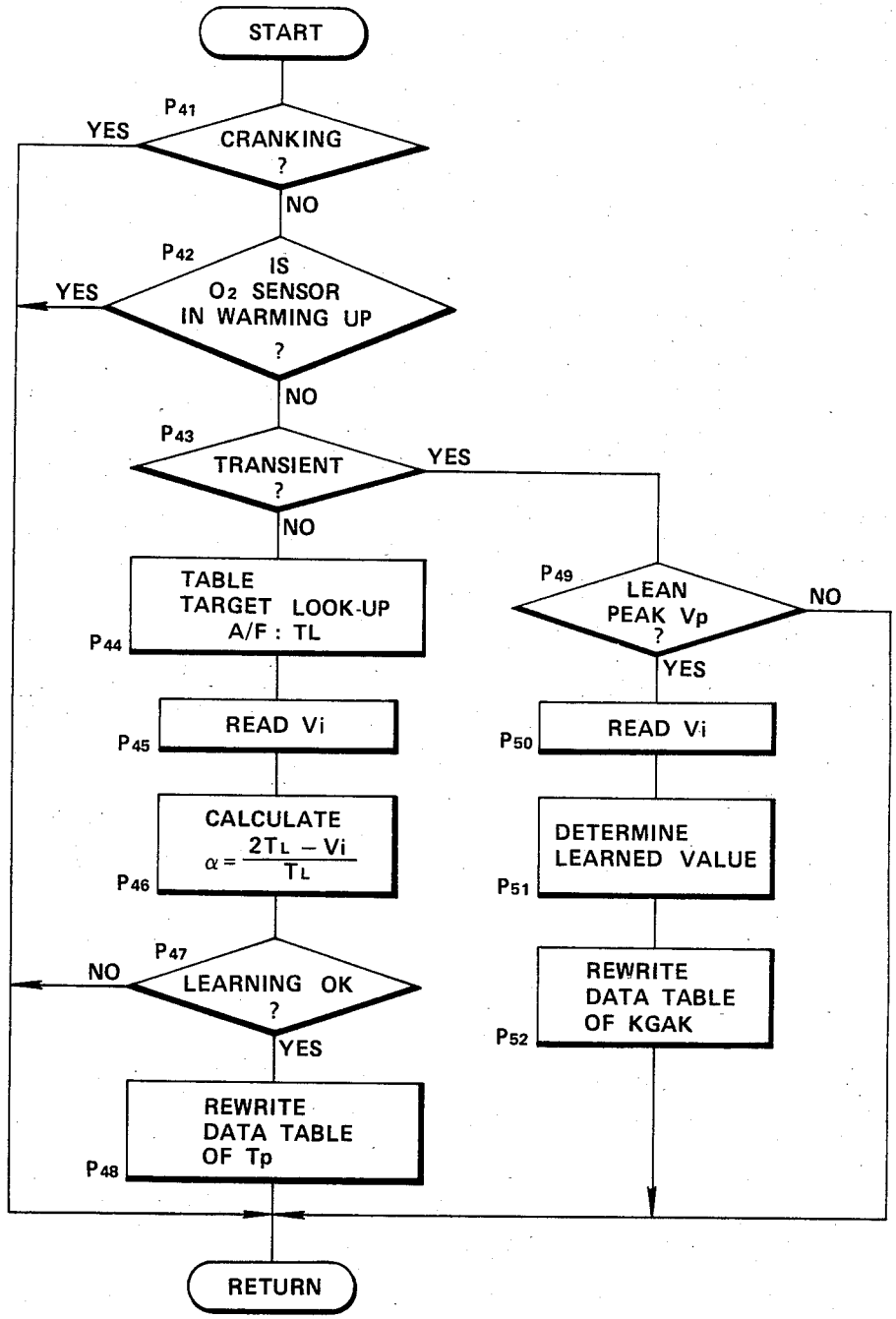
FIG. 12 is a flowchart of a sub-routine of the control program for determining a correction coefficient for correcting deviation in the air/fuel ratio.
Figure 13:
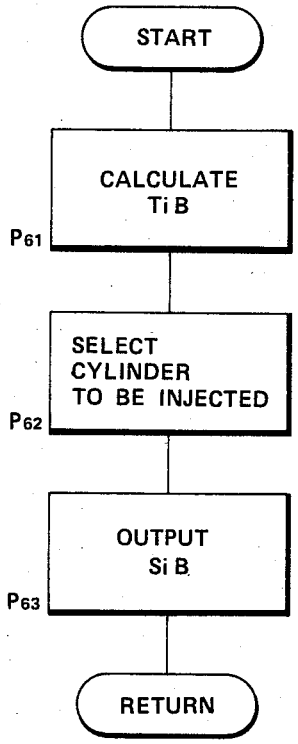
FIG. 13 is a flowchart of a sub-routine of the control program for determining and outputting amount of fuel for additional fuel injection.

The ordinary fuel injection timing is determined in synchronous with the engine rotation. An additional fuel injection which will be described later is effected between the ordinary fuel injections in response to the entry of interruption signal. If the answer to the step P1 is NO, a step P3 is executed to decide whether there is the entry of interruption signal or not. The entry of interruption signal is caused by opening of the throttle valve 5 from the closed position thereof. If the answer to the step P3 is YES, the execution of a sub-routine shown FIG. 13 is caused so as to output additional fuel injection signal SiB after determining an amount of fuel TiB to be injected as additional injection. This additional fuel injection caused by interruption helps in enriching the fuel mixture supplied to the engine. If the answer to the step P3 is NO, steps P5, P6, P7 and P8 are executed. In the step P5, a sub-routine shown in FIG. 7 is executed so as to determine Tp. In the step P6, a sub-routine shown in FIG. 8 is executed so as to determine KT. In the step P7, a sub-routine shown in FIG. 9 is executed so as to determine KKAT. In the step P8, a sub-routine shown in FIG. 12 is executed so as to determine $\alpha$.

Referring to the sub-routine shown in FIG. 7, engine manifold vacuum P and engine speed N are read in a step P11. In a step P12, an optimum value in the basic amount of fuel Tp is determined by table look-up of a data table, stored in the RAM 56, for P and N. In the case intake air flow is measured by a flap type air flow meter, the basic amount of fuel Tp may be determined by calculating the following equation, $$Tp=K1\cdot Qa/N \quad (3)$$

where:

K1=the constant

Qa=the intake air flow.

Referring to the sub-routine shown in FIG. 8, coolant temperature Tw is read in a step P21. In a step P22, an optimum value in a correction coefficient KTw is determined by table look-up of a data table of Tw. In a step P23, intake air temperature Ta is read. In a step P24, an optimum value in a correction coefficient KTa is determined by table look-up of a data table of Ta. In a step P25, a correction coefficient KHs taking into account fuel enrichment after engine startup, fuel enrichment after engine idle and change in atmospheric air pressure, is determined. In a step P26, correction coefficient KT is determined by calculating the following equation, $$KT=Ktw+KTa+KHs \quad (4)$$

Figure 10:
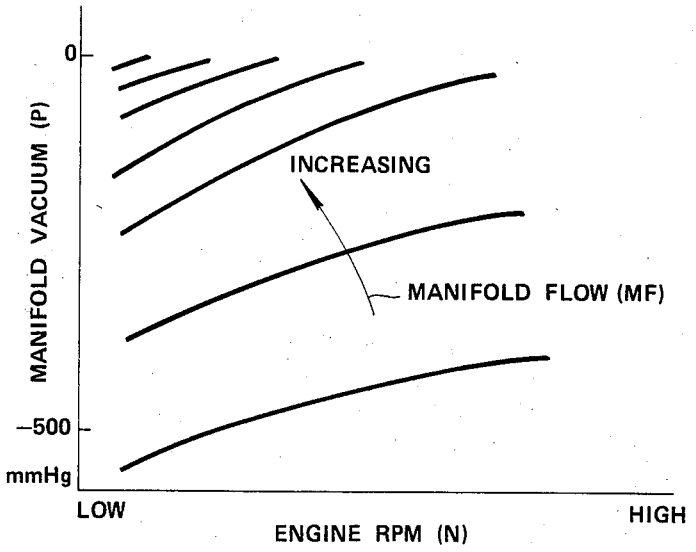
FIG. 10 shows manifold flow of fuel as a function of manifold vacuum and engine speed (rpm)

Referring to FIG. 9, the sub-routine is illustrated which determines the correction coefficient KKAT which is used to increase precision control of the fuel enrichment for transient operation. In order to increase precision control of the amount of fuel for transient enrichment, manifold flow of fuel is taken into account. The manifold fuel flow is the flow of fuel flowing on and along the inner wall of the intake manifold 3. The manifold flow varies with variation in engine operating condition as shown in FIG. 10. As will be readily understood from FIG. 10, the amount of manifold flow changes rapidly in response to a rapid change in manifold vacuum P which would take place under a transient operating condition. Referring to the sub-routine shown in FIG. 9, using the manifold vacuum P and the engine speed N which were read in the step P11 (see FIG. 7), a new value in manifold flow MFnew is determined by a table look-up of a data table as illustrated in FIG. 10. In a step P33, an old value in manifold flow MFold, i.e., the value in manifold flow obtained in the previous routine, is subtracted from the new value MFnew to provide a change on diference DMF (DMF=MFnew−MFold). In a step P34, the value MFnew is set to MFold. In a step P35, a correction coefficient K is determined. This correction coefficient K takes different values so as to set the amount of fuel for enrichment depending upon the change DMF. The optimum values in the correction coefficient K are predetermined and arranged in a data table as a function of engine operating condition. Thus, the correction coefficient K is determined by table look-up of this data table. The data table may be constructed such that the values therein are arranged as function of manifold vacuum P and engine speed N or manifold vacuum P and change in manifold vacuum dp (dp/dt) which is generated by the differentiating circuit 9 (see FIG. 1). In a step P36, a time constant i which is used to calculate an integral iKAT is set. This time constant i represents a gradient of a decaying enrichment curve shown in FIG. 11, and it is retrieved by table look-up for engine operating condition as represented by manifold vacuum P and engine speed N. In a step P37, the integral iKAT is determined by calculating the following equation, $$iKAT=(iKAT+DMF\times K)\times(1-i) \quad (5).$$

Figure 11:
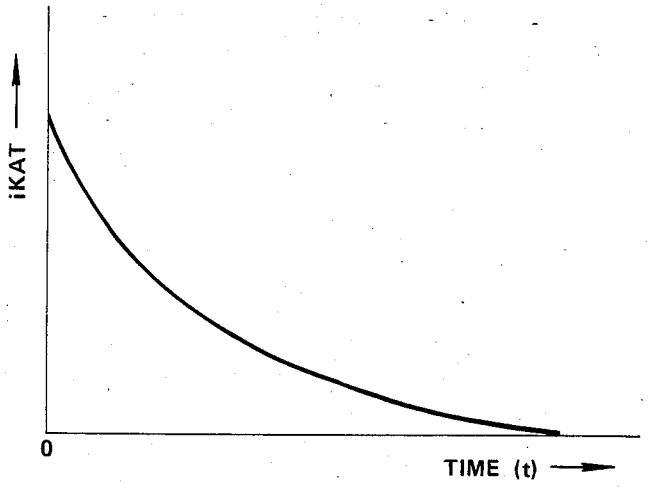
FIG. 11 shows fuel enrichment and decaying after commencement of acceleration.

As shown in FIG. 11, this integral iKAT decreases against the time from the instance (t=o) when an acceleration is initiated, and it is equal to a value resulting from integrating the curve shown in FIG. 11 with respect to time. In a step P38, a correction coefficient KGAK is determined. This correction coefficient KGAK is used to compensate for a change in the time constant i which may be caused by aging of the engine 1. The correction coefficient KGAK is retrieved by a table look-up of a data table stored in the RAM 56 for engine operating condition as represented by manifold vacuum P and engine speed N. The data table containing values in the correction coefficient KGAK may be rewritten after carrying out a learning mode which will be described in the sub-routine shown in FIG. 12.

Finally, in a step P39, the coefficient KKAT is determined by calculating the following equation, $$KKAT=KKTw\times iKAT\times KGAK \quad (6).$$

In the equation (6), the symbol KKTw denotes a correction coefficient for evaporation caused by the coolant temperature Tw. With this correction coefficient KKTw, the amount of fuel for enrichment is appropriately corrected taking into account the fuel evaporation due to the temperature because the amount of evaporation of fuel and the component of fuel to be evaporated vary with different temperatures of the intake manifold 3.

Referring to the sub-routine shown in FIG. 12, in a step P41, a decision is made whether the engine is under cranking or not, and in a step P42, a decision is made whether warming-up of the oxygen sensor 17 is completed or not by measuring whether or not 20 sec. has lapsed after the engine startup. In the case the engine is under cranking or warming-up of the oxygen sensor 17 has not been completed, the calculation of the correction coefficient $\alpha$ is not carried out and set at 1 (one). Under this condition, the feedforward control of the air/fuel ratio is carried out. When the answer to the step P41 and that in the step P42 are both NO, a decision is made whether the engine is under any transient operating condition or not in a step P43. Viz. the decision in this step P43 is made based on the presence or absence of the signals Ca and Cb (see FIG. 1). When the answer to the step P43 is NO, a desired air/fuel ratio TL is determined by table look-up of a data table for intake vacuum P and engine speed N in a step P44. In a step P45, the output Vi indicative of the actual air/fuel ratio is read. In a step P46, the correction coefficient $\alpha$ is determined by calculating, for example, the following equation, $$\alpha=K3\ (2\times TL-Vi)/TL \quad (7)$$

where:

TL=the desired air/fuel ratio,

K3=the coefficient,

Vi=the actual air/fuel ratio.

Using this correction coefficient $\alpha$ as being multiplied with the basic amount of fuel Tp, the feedback control for the air/fuel ratio is carried out. In a step P47, a decision is made whether a predetermined condition is satisfied for learning or not, such that the predetermined learning condition is satisfied when the engine continues to operate under stable operating condition for a predetermined period of time. This is because an operating condition where the air/fuel ratio changes rapidly is not suitable for learning. When the decision in the step P47 indicates that the learning condition is not satisfied, the switching is made to the main routine shown in FIG. 6. When, on the other hand, the decision in the step P47 indicates that the learning condition is satisfied, the value of the data table of the basic amount of fuel Tp which is located at the corresponding address to the present engine operating condition is rewritten by using this correction coefficient $\alpha$. In this manner, an error in the basic amount of fuel Tp due to aging is appropriately corrected, thus maintaining the high reliability of the data table of Tp.

When the decision in the step P43 indicates that the engine is under transient operating condition, a decision is made in a step P49 whether the peak value held in the peak detector 51 is lean or not. When the lean peak Vp has not been occurred, the learning is bypassed. When the lean peak Vp has occurred, the sensor output Vi is read in a step P50. When the throttle valve 5 is opened from the closed position for a rapid acceleration, the amount of intake air increases and the fuel mixture becomes lean for a moment. Thus, the sensor output Vi indicative of the actual air/fuel ratio will have the lean peak Vp. It is confirmed that the occurrence of the lean peak Vp coincides with the timing when the manifold flow MF becomes maximum owing to a rapid drop in manifold vacuum P immediately after acceleration. The acceleration performance is enhanced by promptly correcting the tendency of the air/fuel ratio to become lean which otherwise would occur after acceleration. Therefore, the actual air/fuel ratio at this instance is accurately detected by measuring the sensor output Vi in the step P50. In a step P51, a leaned value correlated with this actual air/fuel ratio is determined. This arithmetic operation is performed based on the peak value Vp held immediately after the initiation of acceleration and the actual air/fuel ratio in terms of sensor voltage Vi. In practice, a data table is prepared reflecting the results obtained by experiment and a table look-up of this data table is executed for the peak value Vp and air/fuel ratio Vi. In a step P52, the value in the data table of KGAK which is located at the corresponding address for the air/fuel ratio is rewritten using the value obtained in the step P51, thus enhancing the accuracy of the data. Then, $\alpha$ is set at 1.

It will now be appreciated that, with the data whose accuracy is maintained in the above manner, the feed-forward control of the air/fuel ratio is carried out at acceleration, so the air/fuel ratio is brought into the desired value promptly. The desired value for transient operation does not indicate a desired air/fuel ratio per se, but it may be regarded as the amount of fuel injection including the amount of fuel boost.

Referring to the sub-routine shown in FIG. 13, in a step P61, the amount of fuel TiB is determined for operating state as represented by intake vacuum P and engine rotational speed N. The determination of the amount of fuel TiB may be made in a similar manner to that in which the basic amount of fuel injection Tp is determined. Alternatively, a predetermined amount of fuel may be set as TiB. In a step P62, a decision is made which of the cylinders should receive injection of fuel, and then, in a step P63, the interruption fuel injection signal SiB is output.

Referring to the sub-routine shown in FIG. 14, in a step P71, the ordinary amount of fuel injection Ti is determined by calculating the before mentioned equation (2), and then the fuel injection signal Si is output in a step P72.

Although, in this embodiment, the engine load is calculated primarily on manifold vacuum P, the present invention is not limited to the use of manifold vacuum P. Alternatively any variable which represents the output demand by a driver may be used, for example, the amount of intake air flow, and the throttle opening degree.

What is claimed is:

1. A system for controlling an air/fuel ratio of a fuel mixture supplied to an internal combustion engine having an exhaust system for passing therethrough exhaust gases resulting from combustion of the fuel mixture within the engine, the control system comprising:

means for detecting an air/fuel ratio of the fuel mixture over a range from a rich range portion to a lean range portion thereof by probing the exhaust gases and generating an actual air/fuel ratio indicative signal;

means for detecting a predetermined transient operating condition of the engine and generating a transient operating condition indicative signal;

means for determining a basic amount of fuel required by the engine and generating a basic amount indicative signal;

means for determining a target value in air/fuel ratio and generating a target air/fuel ratio indicative signal;

means responsive to said actual air/fuel ratio indicative signal and said target air/fuel ratio indicative signal for determining an air/fuel ratio correction coefficient and generating an air/fuel ratio correction coefficient indicative signal;

means for storing values related with transient enrichment coefficient in a data table;

means for retrieving said data table so as to determine a transient enrichment correction coefficient and generating a transient enrichment correction coefficient indicative signal;

means responsive to said transient operating condition indicative signal for rewritting part of said data table; and means for correcting said basic amount indicative signal with one of said air/fuel ratio correction coefficient indicative signal and said transient enrichment correction coefficient indictive signal selected in response to said transient operating condition indicative signal.

2. A system as claimed in claim 1, wherein said basic amount indicative signal generating means includes:

means for storing values in basic amount of fuel required by the engine in a second data table as a function of parameters indicative of various operating conditions of the engine.

3. A system as claimed in claim 2, further comprising:

means for rewritting part of said second data table after a predetermined condition has been satisfied, said predetermined condition involving the absence of said transient operating condition indicative signal.

4. A system as claimed in claim 1, wherein said transient operating condition indicative signal generating means comprises:

means for detecting the engine load and generating an engine load indicative signal;

means for differentiating said engine load indicative signal so as to determine a time derivative and generating a time derivative indicative signal; and means for comparing said time derivative indicative signal with a reference and generating said transient operating condition indicative signal.

* * * * *